US009435551B2

(12) United States Patent
Dinh

(10) Patent No.: US 9,435,551 B2
(45) Date of Patent: Sep. 6, 2016

(54) DEHUMIDIFIER DRYER USING AMBIENT HEAT ENHANCEMENT

(76) Inventor: Khanh Dinh, Gainesville, FL (US)

( * ) Notice: Subject to any disclaimer, the term of this patent is extended or adjusted under 35 U.S.C. 154(b) by 566 days.

(21) Appl. No.: 13/616,914

(22) Filed: Sep. 14, 2012

(65) Prior Publication Data

US 2013/0067939 A1 Mar. 21, 2013

Related U.S. Application Data

(60) Provisional application No. 61/535,011, filed on Sep. 15, 2011.

(51) Int. Cl.

| | |
|---|---|
| ***F24F 3/00*** | (2006.01) |
| ***F24F 3/14*** | (2006.01) |
| ***F24F 12/00*** | (2006.01) |
| ***F24F 3/153*** | (2006.01) |
| *F25B 5/04* | (2006.01) |

(52) U.S. Cl.

CPC ..... *F24F 3/153* (2013.01); *F24F 2003/144* (2013.01); *F25B 5/04* (2013.01)

(58) Field of Classification Search

CPC . F25D 2317/0411; F24F 3/14; F24F 3/1405; F24F 3/1423; F24F 3/1429; F24F 3/1458; F24F 3/1464; F24F 3/147; F24F 3/144; F24F 3/1146; F24F 3/1452; F24F 3/1417; F24F 2003/1146; F24F 12/00; F24F 12/001

See application file for complete search history.

(56) References Cited

U.S. PATENT DOCUMENTS 2,048,137 A * 7/1936 Palmer ..... F24F 3/153 165/230
2,091,562 A * 8/1937 Palmer ..... F24F 3/1405 165/244
2,729,072 A * 1/1956 Dybvig ..... 62/325
4,180,985 A * 1/1980 Northrup, Jr. ..... B01D 53/26 62/271
4,960,166 A 10/1990 Hirt
5,031,411 A 7/1991 Gehring et al.
5,383,339 A 1/1995 McCloskey et al.
5,582,246 A 12/1996 Dinh
5,613,372 A 3/1997 Beal et al.
5,727,623 A 3/1998 Yoshioka et al.
5,794,453 A 8/1998 Barnwell (Continued)

FOREIGN PATENT DOCUMENTS

JP 2006266518 A 10/2006

*Primary Examiner* — Frantz Jules
*Assistant Examiner* — Erik Mendoza-Wilkenfe
(74) *Attorney, Agent, or Firm* — Mai-Tram D. Lauer; Westman, Champlin & Koehler

(57) ABSTRACT

An apparatus is configured to receive an incoming air stream from within an enclosure and to exhaust an outgoing air stream into the enclosure, the incoming and outgoing air streams flowing in a flow direction. The apparatus comprises an evaporator, a compressor, a condenser, and a heat exchanger. The heat exchanger has a heat extraction portion and a heat depositing portion, wherein the heat extraction portion is disposed in an air stream outside of the enclosure and wherein the heat depositing portion is disposed downstream of the evaporator with respect to the flow direction. A method includes receiving an incoming air stream from within an enclosure in a dryer apparatus, the apparatus including an evaporator, a compressor, and a condenser. A heat exchanger is operably connected to the dryer apparatus to transfer sensible heat from an air stream outside of the enclosure to a location downstream of the evaporator.

19 Claims, 3 Drawing Sheets

(56) References Cited

U.S. PATENT DOCUMENTS 5,845,702 A 12/1998 Dinh
5,921,315 A * 7/1999 Dinh ..... 165/104.21
5,953,926 A 9/1999 Dressler et al.
6,029,467 A * 2/2000 Moratalla ..... B01D 53/265 165/8
6,290,758 B1 * 9/2001 Mowat ..... 96/126
6,427,454 B1 8/2002 West
6,546,746 B2 4/2003 Forkosh et al.
6,581,394 B1 6/2003 Smolenkiy
6,591,902 B1 * 7/2003 Trent ..... F24F 1/0059 165/104.14
6,684,649 B1 * 2/2004 Thompson ..... B01D 53/263 62/272
6,959,492 B1 11/2005 Matsumoto
7,165,414 B2 * 1/2007 Wright ..... F24F 3/153 62/277
7,194,870 B1 3/2007 O'Brien
7,290,399 B2 11/2007 Taras et al.
7,350,366 B2 4/2008 Yakumaru
7,770,405 B1 8/2010 Dillon
7,770,411 B2 8/2010 Knight et al.
8,020,395 B2 9/2011 Kotani et al.
8,262,263 B2 * 9/2012 Dinh ..... F21K 9/00 165/104.21
2003/0208923 A1 11/2003 Lewis
2006/0087810 A1 * 4/2006 Rockenfeller ..... G06F 1/20 361/679.47
2008/0085437 A1 * 4/2008 Dean ..... B01D 53/268 429/413
2008/0223050 A1 9/2008 Bruders et al.
2009/0095162 A1 4/2009 Hargis et al.
2010/0018228 A1 * 1/2010 Flammang et al. ..... 62/115
2010/0212345 A1 * 8/2010 Yoon ..... F24F 3/1423 62/271
2011/0167849 A1 * 7/2011 Kobayashi ..... B60H 1/00914 62/159
2011/0308265 A1 * 12/2011 Phannavong ..... F24F 12/001 62/160

* cited by examiner

DEHUMIDIFIER DRYER USING AMBIENT HEAT ENHANCEMENT

CROSS REFERENCE TO RELATED APPLICATIONS

This application claims the benefit of priority from, and hereby incorporates by reference, U.S. Provisional Patent Application Ser. No. 61/535,011, filed Sep. 15, 2011, by Khanh Dinh.

BACKGROUND

Dehumidifier dryers have been used for applications such as water damage remediation for the drying of flooded houses and other buildings. However, all of the state-of-the-art dryers provide heat energy obtained only from the energy from electric consumption and the latent energy resulting from condensing of water vapors.

SUMMARY

In one aspect, the disclosure is directed to an apparatus configured to receive an incoming air stream from within an enclosure and to exhaust an outgoing air stream into the enclosure, the incoming and outgoing air streams flowing in a flow direction. The apparatus comprises an evaporator, a compressor, a condenser, and a heat exchanger. The heat exchanger has a heat extraction portion and a heat depositing portion, wherein the heat extraction portion is disposed in an air stream outside of the enclosure and wherein the heat depositing portion is disposed downstream of the evaporator with respect to the flow direction.

In another aspect, the disclosure describes a method comprising receiving an incoming air stream from within an enclosure in a dryer apparatus, the apparatus comprising a first evaporator, a compressor, and a condenser, the incoming air stream flowing in a flow direction. A heat exchanger is operably connected to the dryer apparatus to transfer sensible heat from an air stream outside of the enclosure to a location downstream of the evaporator with respect to the flow direction. An outgoing air stream is exhausted into the enclosure, the outgoing air stream flowing in the flow direction.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

The present disclosure is directed to a dehumidifier dryer using ambient heat enhancement. A particularly suitable application for such a dryer is for use in drying out an enclosure such as a flooded building, for example.

Figure 1:
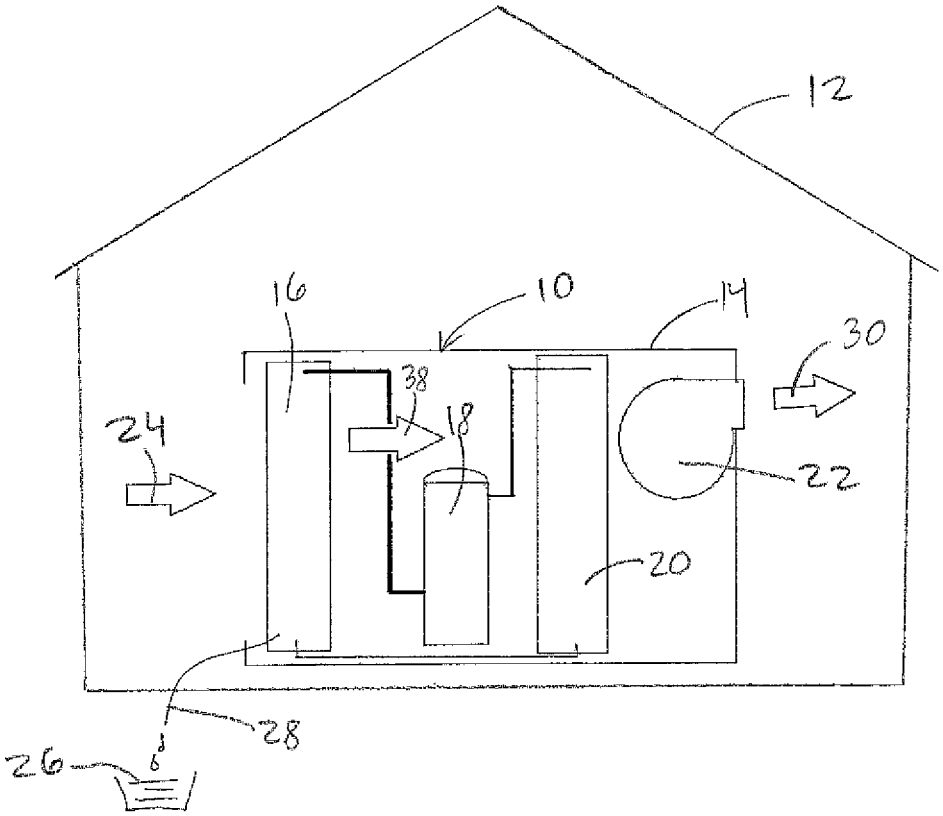
Fig. 1 (prior art)
FIG. 1 is a schematic elevation view of a prior art refrigeration-based dehumidifier dryer installed in an enclosure.

FIG. 1 is a schematic elevation view of a prior art refrigeration-based dehumidifier dryer 10 installed in an enclosure 12, which in the illustrated example is a building with an interior that needs to be dried. Latent heat energy in the building air, available in the form of water vapor, is transformed into sensible heat energy by cooling the building air below its dew point to condense the water vapor into liquid water that is then removed. The heat of condensation is released in the dehumidification process; additional heat also comes from electricity used to power the compressor and blower. The warmer, dryer air is used for drying the building 12.

In the illustrated embodiment, dryer 10 includes a housing 14 that contains evaporator or cooling coil 16, compressor 18, condenser 20, and blower 22, as is known in the art. In an exemplary embodiment, enclosure 12 is a building in which the air is more moist than desired. In an extreme case, the building may have been flooded or otherwise water-damaged. Thus, dryer 10 is used to dry out the building structure and the air within the building. In an exemplary application, the air in the building need not be controlled for human comfort; rather, the air is warmer than typical for enhanced drying effectiveness.

In a first example, incoming air stream 24 enters dryer 10 at 80 degrees Fahrenheit (F). Evaporator 16 reduces the air temperature of air exiting the evaporator 38 to 55 F, thereby condensing water vapor from incoming air stream 24. This liquid water condensate 26 is removed from enclosure 12, such as through drain line 28. A 1,000-watt compressor 18 produces 12,000 British Thermal Units per hour (BTUh). A 300-watt blower 22 moves air through dryer 10 at a rate of 1,000 cubic feet per minute (cfm). The outgoing air stream 30 exits dryer 10 at 100 F. A typical dehumidifier dryer 10 can condense water vapor and release latent heat of condensation at a rate of 5,000 BTUh. Additionally, the heat resulting from consumption of 1,300 watt.hour of electricity adds 4,434 BTUh. Thus, a total useable heat amount of 9,434 BTUh is available for drying the enclosure 12.

Figure 2:
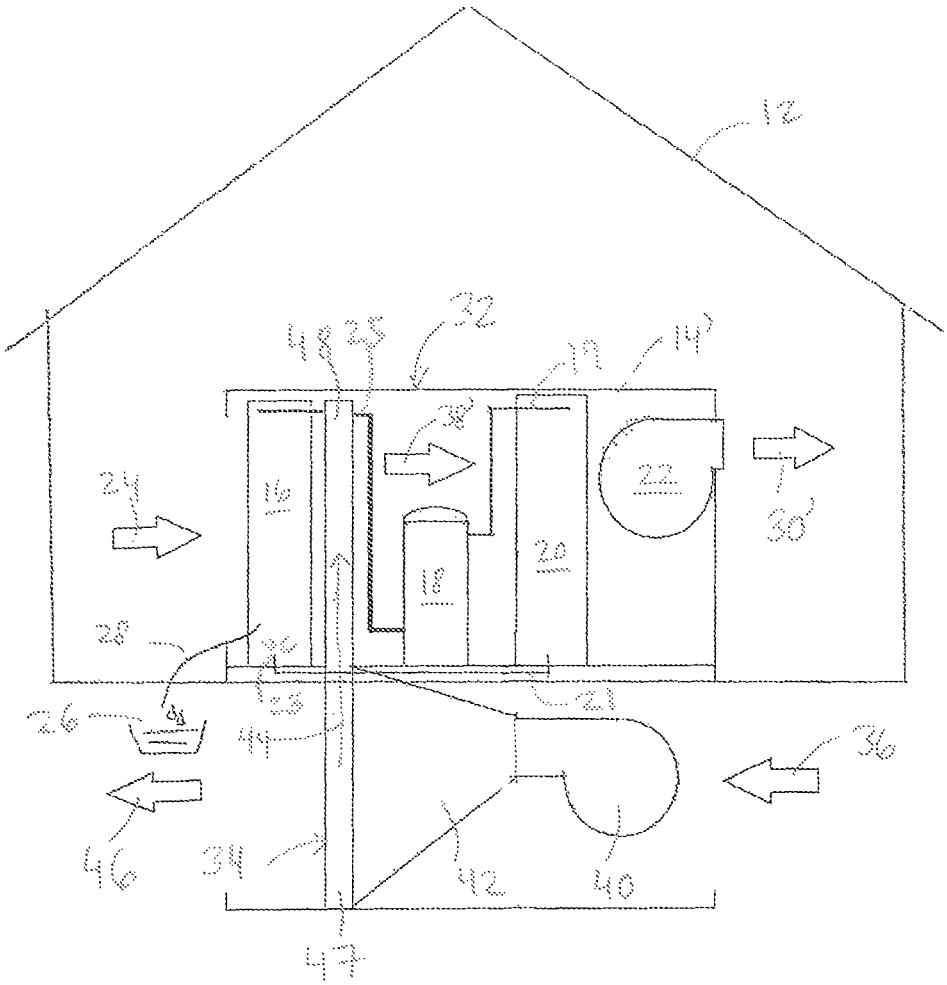
FIG. 2 is a schematic elevation view of a first exemplary embodiment of a refrigeration-based dehumidifier dryer installed in an enclosure.

FIG. 2 shows an exemplary embodiment of the present disclosure, which is a refrigeration-based dehumidifier dryer apparatus 32 that uses a heat exchanger 34 to extract heat from the ambient outdoor air stream 36. Dryer 32 is configured to receive incoming air stream 24 from within enclosure 12 and to exhaust outgoing air stream 30' into enclosure 12. The incoming and outgoing air streams 24, 30' flow in a flow direction indicated by the arrows in the FIG. 2. As illustrated in FIG. 2, ambient outdoor air stream 36 flows counter-current to incoming and outgoing air streams 24, 30'. However, it is contemplated that ambient outdoor air stream 36 may flow in the same direction as incoming and outgoing air streams 24, 30' or in another direction, as directed by blower 40.

Compressor 18 delivers hot compressed refrigerant gas to condenser 20 via line 19. Condenser 20 receives the refrigerant gas and condenses it to produce hot refrigerant liquid. The hot refrigerant liquid travels via line 21 to expansion device 23. Expansion device 23 receives the refrigerant liquid from condenser 20 and expands the refrigerant liquid to reduce the temperature and pressure of the liquid. Evaporator 16 receives the cool liquid refrigerant from expansion device 23 and evaporates the liquid refrigerant to produce cold gas refrigerant, which is returned to compressor 18 via line 25 to complete the refrigeration cycle. Incoming air stream 24 is directed across the evaporator 16 to cool the air below the dew point such that water vapor in the air is condensed to liquid condensate 26 to dehumidify the air. The dehumidified air exiting the evaporator 38' is then directed across condenser 20 to rewarm the air.

In the embodiment of dryer 32 illustrated in FIG. 2, the extracted heat from the outdoor air stream 36 is used to supplementally heat the air exiting the evaporator 38'. The reheated air exiting the evaporator 38' continues to the condenser 20 to get further heated. As a result, the air coming out of dryer 32 will include three sources of heat: latent heat from condensing water vapors in the air, heat resulting from the use of electricity by the compressor and blower, and also the heat energy transferred into the cold air stream exiting the evaporator 38 via the outdoor air heat exchanger 34. Thus, outgoing air stream 30' discharged into an interior of the enclosure 12 is warmer than in FIG. 1 because of the added sensible heat from outdoors. Because this additional heat is free, it increases the efficiency of the whole system.

In a second example, the same entering air conditions, compressor, and blower are used as in the first example. Thus, ambient air enters the dryer at 80 degrees Fahrenheit (F.). The evaporator 16 reduces the air temperature to 55 F, thereby condensing water vapor from the air, which is thereby removed through drain line 28 as condensate 26. A 1,000-watt compressor 18 produces 12,000 British Thermal Units per hour (BTUh). A first 300-watt blower 22 moves the air at a rate of 1,000 cubic feet per minute (cfm). A second 1,000 cfm blower 40 pulls outdoor air stream 36 (at 80 F) through heat exchanger 34 via a coupling 42 that maximizes air flow from blower 40 to heat exchanger 34.

In an exemplary embodiment, heat exchanger 34 has a heat extraction portion 47 and a heat depositing portion 48. Heat extraction portion 47 is disposed in outdoor air stream 36. In this case, "outdoor" refers to an area outside of enclosure 12. Heat depositing portion 48 is disposed downstream of evaporator 16 with respect to the flow direction of incoming air stream 24. Thus, sensible heat is extracted from outdoor air stream 36 at heat extraction portion 47, moves through heat exchanger 34 in direction 44, and is picked up by air exiting the evaporator 38' as that air stream flows through heat depositing portion 48. In one embodiment, heat exchanger 34 transfers sensible heat in direction 44 from outdoor air stream 36 to the air leaving the evaporator 38', thereby warming the air by 10 F. Thus, air leaving the coiling coil 38' that has passed through heat exchanger 34 has a temperature of 65 F. The gain of 10 F of heat from heat exchanger 34 results in outgoing air stream 30' exiting dryer 32 at 110 F. Moreover, because 10 F of heat is transferred by heat exchanger 34, outgoing air stream 46 exiting heat exchanger 34 is cooled to 70 F.

Suitable types of known heat exchangers 34 include, for example, heat pipes, tube heat exchangers, heat wheels, liquid loops, plate type, and thermosiphon heat exchangers. The manner of connecting the heat exchanger 34 to the dryer 32 to transfer sensible heat from the outdoor air stream 36 to the air leaving the evaporator 38' will depend on the type of heat exchanger 34 chosen. Such manners of connection are known in the art. U.S. Pat. No. 5,921,315 to Dinh, incorporated herein by reference, discloses a suitable three-dimensional heat pipe heat exchanger. U.S. Pat. No. 5,845,702 to Dinh, incorporated herein by reference, discloses a suitable serpentine heat pipe heat exchanger. U.S. Pat. No. 5,582,246 to Dinh, incorporated herein by reference, discloses a suitable finned tube heat exchanger. U.S. Pat. No. 4,960,166 to Hirt, incorporated herein by reference, discloses a suitable rotary heat wheel. U.S. Pat. No. 6,959,492 to Matsumoto, incorporated herein by reference, discloses a suitable plate type heat exchanger. U.S. Pat. No. 8,262,263 to Dinh, incorporated herein by reference, discloses suitable liquid loop and thermosiphon heat exchangers.

An exemplary calculation follows: with a reasonable effectiveness of 50%, the amount of heat that can be captured from ambient outdoor air stream 36 by heat exchanger 34 will be about 1,000 cfm×10 F×1.08=10,800 BTUh. This calculation is based on a "quick formula" known in the trade of air conditioning: 1,000 cfm is the air volume through heat exchanger 34; 10 F is the sensible heat gain; the factor of 1.08 reflects the conversion of cfm into flow mass in pounds of air per hour times the specific heat of air at standard conditions. Thus, the total amount of heat delivered will be 9,434 (from the first example)+10,800 (from the quick formula)=20,234 BTUh, which is more than double the amount of heat from the conventional dehumidifier dryer 10 of FIG. 1. Moreover, heat exchangers 34 with even higher effectiveness levels may be used to yield even more usable heat. Since only sensible heat is transferred from the outdoor air stream 36 to the process air stream 24, 38', no humidity is added to the outgoing air stream 30. Therefore the hotter, dry outgoing air stream 30 will be able to provide more drying capacity as compared to the first example. Considering that a second blower 40 is typically used to draw outdoor air stream 36 through heat exchanger 34, some extra energy will be needed, but that amount of energy will be small compared to the heat energy extracted as above explained.

Figure 3:
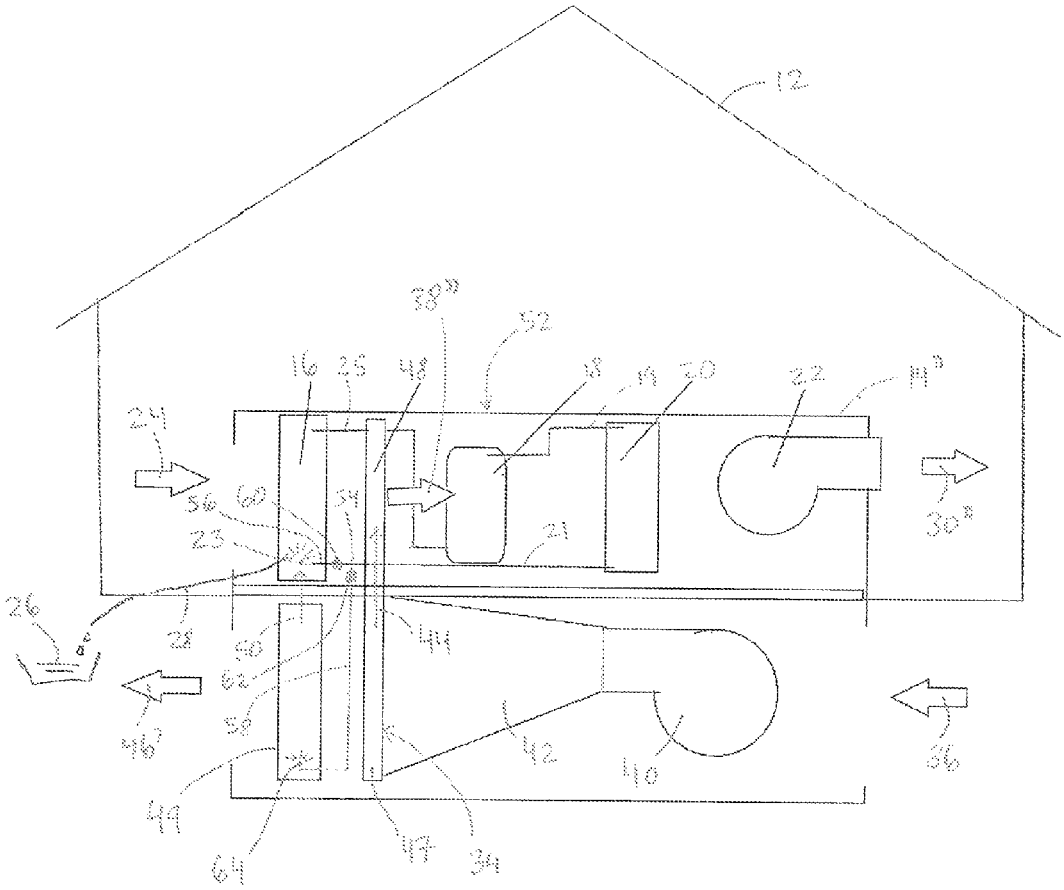
FIG. 3 is a schematic elevation view of a second exemplary embodiment of a refrigeration-based dehumidifier dryer installed in an enclosure.

FIG. 3 shows the addition of a second evaporator 49 placed after the heat exchanger 34 discharge to further extract heat from the outdoor air stream 36 as it reduces the temperature of the outgoing air stream 46'. This extracted heat can be directed back into the building as shown by recycle heat stream 50, thereby contributing to warming air exiting the evaporator 38" and outgoing air stream 30" even further. This is especially desirable for cold climates. In other respects, machine 52 works similarly to dryer 32, shown in FIG. 2. When the configuration of FIG. 3 is used, the machine 52 becomes a combined dehumidifier and heat pump. U.S. Pat. No. 7,350,366 to Yakumaru, incorporated herein by reference, discloses a heat pump.

Compressor 18 delivers hot compressed refrigerant gas to condenser 20 via line 19. Condenser 20 receives the refrigerant gas and condenses it to produce hot refrigerant liquid. The hot refrigerant liquid travels via line 21 to juncture 54, at which line 21 branches to segment 56 leading to evaporator 16 and segment 58 leading to evaporator 48. The operation of one or both evaporators 16, 48 is controlled by valves 60, 62, respectively. In an exemplary embodiment, valves 60, 62 are solenoid valves, as are known in the art. When valve 60 is open, the refrigerant travels to expansion device 23 of evaporator 16; when valve 60 is closed, evaporator 16 does not run. When valve 62 is open, the refrigerant travels to expansion device 64 of evaporator 48; when valve 62 is closed, evaporator 48 does not run. Thus, valves 60, 62 are controllable so that just evaporator 16 can run, so that machine 52 operates as a dehumidifier (primarily remove moisture from enclosure 12); just evaporator 48 can run, so that machine 52 operates as a heat pump (primarily add heat to enclosure 12); and both evaporators 16, 48 can run simultaneously, so that machine 52 operates as a combined dehumidifier and heat pump (remove moisture from and add heat to enclosure 12).

When valve 60 is open, expansion device 23 receives the refrigerant liquid from condenser 20 and expands the refrigerant liquid to reduce the temperature and pressure of the liquid. Evaporator 16 receives the cool liquid refrigerant from expansion device 23 and evaporates the liquid refrigerant to produce cold gas refrigerant, which is returned to compressor 18 via line 25 to complete the refrigeration cycle. When valve 62 is open, expansion device 64 receives the refrigerant liquid from condenser 20 and expands the refrigerant liquid to reduce the temperature and pressure of the liquid. Evaporator 48 receives the cool liquid refrigerant from expansion device 64 and evaporates the liquid refrigerant to produce cold gas refrigerant, which is returned to compressor 18 via a line (not shown) to complete the refrigeration cycle. Incoming air stream 24 is directed across the evaporator 16 to cool the air below the dew point such that water vapor in the air is condensed to liquid condensate 26 to dehumidify the air. The dehumidified air exiting the evaporator 38' is then directed across condenser 20 to rewarm the air. Outdoor air stream 36 is directed across evaporator 48 to extract heat therefrom so that recycle heat stream 50 can be directed back into enclosure 12.

Although the subject of this disclosure has been described with reference to several embodiments, workers skilled in the art will recognize that changes may be made in form and detail without departing from the spirit and scope of the disclosure. In addition, any feature disclosed with respect to one embodiment may be incorporated in another embodiment, and vice-versa. Moreover, all patents and publications mentioned in this disclosure are fully incorporated by reference.

What is claimed is:

1. An apparatus configured to receive an incoming air stream having a first temperature from within an enclosure and to exhaust an outgoing air stream into the enclosure, the incoming and outgoing air streams flowing in a flow direction, the apparatus comprising:

a first evaporator through which the incoming air stream flows so that a second air stream exiting the first evaporator has a second temperature that is lower than the first temperature;

a compressor;

a condenser being within the enclosure; and a heat exchanger having a heat extraction portion and a heat depositing portion, wherein:

the heat extraction portion is disposed in a third air stream outside of the enclosure, the third air stream having a third temperature greater than the second temperature, wherein the third air stream and the second air stream are not fluidly connected, wherein the heat depositing portion is disposed downstream of the evaporator with respect to the flow direction, wherein the heat depositing portion in the second airstream is located upstream of the condenser, and wherein the heat exchanger transfers sensible heat from the heat extraction portion in the third air stream to the heat depositing portion in the second air stream.

2. The apparatus of claim 1 wherein the heat exchanger comprises a heat pipe.

3. The apparatus of claim 1 wherein the heat exchanger comprises a tube heat exchanger.

4. The apparatus of claim 1 wherein the heat exchanger comprises a rotary heat wheel.

5. The apparatus of claim 1 wherein the heat exchanger comprises a liquid loop.

6. The apparatus of claim 1 wherein the heat exchanger comprises a plate type heat exchanger.

7. The apparatus of claim 1 wherein the heat exchanger comprises a thermosiphon heat exchanger.

8. The apparatus of claim 1 further comprising a second evaporator disposed downstream of the heat extraction portion with respect to the third air stream outside of the enclosure.

9. The apparatus of claim 8 further comprising a recycle heat stream flowing from the second evaporator to the enclosure.

10. The apparatus of claim 8 further comprising a first valve for selectively controlling operation of the first evaporator.

11. The apparatus of claim 10 further comprising a second valve for selectively controlling operation of the second evaporator.

12. A method comprising:

receiving an incoming air stream having a first temperature from within an enclosure in a dryer apparatus, the apparatus comprising a first evaporator, a compressor, and a condenser, the condenser being within the enclosure, the incoming air stream flowing in a flow direction, wherein the incoming air stream flows through the first evaporator so that a second air stream exiting the first evaporator has a second temperature that is lower than the first temperature;

operably connecting a heat exchanger to the dryer apparatus to transfer sensible heat from a third air stream outside of the enclosure, the third air stream having a third temperature greater than the second temperature, to a location in the second air stream downstream of the evaporator and upstream of the condenser with respect to the flow direction, wherein the third air stream and the second air stream are not fluidly connected; and exhausting an outgoing air stream into the enclosure, the outgoing air stream flowing in the flow direction.

13. The method of claim 12 further comprising operable connecting a second evaporator disposed downstream of the heat exchanger with respect to the third air stream outside of the enclosure.

14. The method of claim 13 further comprising transferring sensible heat from the second evaporator to the enclosure.

15. The method of claim 13 further comprising selectively controlling operation of the first evaporator.

16. The method of claim 13 further comprising selectively controlling operation of the second evaporator.

17. The method of claim 13 wherein the first evaporator operates while the second evaporator does not operate.

18. The method of claim 13 wherein the second evaporator operates while the first evaporator does not operate.

19. The method of claim 13 wherein the both the first evaporator and the second evaporator operate simultaneously.

* * * * *